United States Patent [19]

Sugimoto

[11] Patent Number: 4,990,071

[45] Date of Patent: Feb. 5, 1991

[54] SCROLL TYPE FLUID APPARATUS HAVING TWO ORBITING END PLATES LINKED TOGETHER

[75] Inventor: Kazuo Sugimoto, Isesaki, Japan

[73] Assignee: Sanden Corporation, Gunma, Japan

[21] Appl. No.: 350,762

[22] Filed: May 12, 1989

[30] Foreign Application Priority Data

May 12, 1988 [JP] Japan ..... 63-113544

[51] Int. Cl.[5] ..... F01C 1/04; F01C 11/00; F01C 17/06

[52] U.S. Cl. ..... 418/55.2; 418/55.3; 418/55.5; 418/60; 418/151; 418/183

[58] Field of Search ..... 418/55 R, 55 A, 55 B, 418/55 D, 57, 60, 151, 183

[56] References Cited

U.S. PATENT DOCUMENTS

| | | | |
|---|---|---|---|
| 2,684,036 | 7/1954 | Stratveit | 418/151 |
| 3,989,422 | 11/1976 | Guttinger | 418/60 |
| 4,475,875 | 10/1984 | Sugimoto et al. | 418/151 |
| 4,477,238 | 10/1984 | Terauchi | 418/5 |

FOREIGN PATENT DOCUMENTS

| | | | |
|---|---|---|---|
| 3141525 | 10/1981 | Fed. Rep. of Germany . | |
| 707807 | 12/1930 | France . | |
| 2300238 | 2/1976 | France . | |
| 58-62301 | 4/1983 | Japan . | |
| 59-65586 | 4/1984 | Japan | 418/60 |
| 62-183092 | 8/1987 | Japan . | |

*Primary Examiner*—John J. Vrablik

*Attorney, Agent, or Firm*—Banner, Birch, McKie & Beckett

[57] ABSTRACT

A scroll type supercharger including first and second orbital spiral elements is disclosed. The supercharger includes a first orbiting scroll having a first orbiting end plate from which a first spiral element extends, and a second oribting end plate fixedly attached to said first orbiting end plate, and from which a second spiral element extends. A hollow portion is formed between the first and second orbiting end plates. The housing includes a first casing further including a first fixed scroll having a first fixed spiral element extending therefrom. The housing also includes a second casing from which a second fixed scroll extends. The first and second casings are fixedly attached to form an operating chamber therein. The orbiting scroll is disposed in the operating chamber such that the orbiting scroll is disposed at an angular and radial offset with said fixed scrolls to form at least one pair of sealed off fluid pockets between interfitting pairs of fixed and orbiting spiral elements. The apparatus further includes a drive shaft having a crank pin disposed about its exterior surface. A longitudinal and radial bore extend through the crank pin, linking central fluid pockets on either side of the orbiting scroll with the hollow portion formed between the first and second orbiting end plates such that the pressure on either side of each orbiting end plate is equalized with the pressure within the outer fluid cavities to prevent bending and warping of the end plates.

15 Claims, 2 Drawing Sheets

SCROLL TYPE FLUID APPARATUS HAVING TWO ORBITING END PLATES LINKED TOGETHER

BACKGROUND OF THE INVENTION

1. Field of the Invention

This invention relates to scroll type fluid apparatuses, and more particularly, to a scroll type supercharger for use with an automotive engine.

2. Description of the Prior Art

Scroll type fluid apparatuses are known in the art and may be designed as either compressors or superchargers. If a high compression ratio is required, the scroll type fluid apparatus is designed as a compressor as disclosed in U.S. Pat. No. 4,477,238 to Terauchi, hereby incorporated by reference. However, compressors, as in the '238 patent, have a low discharge flow rate. If, a high discharge flow rate is required, rather than a high compression ratio, the scroll type fluid apparatus may be designed as a supercharger as disclosed in Japanese Patent Application Publication No. 58-62,301. However, the supercharger has a significantly reduced compression ratio as compared to the compressor disclosed in the '238 patent.

Additionally, the discharge rate of the scroll supercharger is limited due to mechanical limitations on the length of the spiral elements of the scrolls. The length of the spiral element is limited because as the length is increased, the strength of the scrolls is decreased, and the difficulty in machining increases. Superchargers having an increased discharge flow rate in comparison with the supercharger of the '301 application are known, for example, the roots displacement compressor as disclosed in Japanese Utility Model Application Publication No. 62-183,092. However, the compressor of the '092 publication has a much larger exterior dimension than the supercharger shown in the '301 application.

Scroll type superchargers having increased discharge flow rate without suffering the drawback of having an increased exterior dimension are known, as shown in West German Patent Application Publication No. DE 3,141,525-A. The scroll type supercharger disclosed in the '525 application includes an orbiting scroll having a single end plate member from which first and second orbiting spiral elements extend from opposite sides. The orbiting scroll is disposed in a housing which includes two opposite sides, such that third and fourth fixed spiral elements project inwardly from each side. The third spiral element interfits with the first spiral element to define at least one pair of fluid pockets therebetween. Similarly, the fourth spiral element projects from the opposite side of the housing and interfits with the second spiral element to form at least one pair of fluid pockets therebetween.

The drive mechanism includes a crank shaft extending centrally through the housing. Orbital motion is effected by a crank pin disposed about and fixed to the drive shaft, such that the central axis of the crank pin is offset from the central axis of the drive shaft. The crank shaft is centrally disposed through the single plate member which is supported by bearings about the crank pin. Rotational motion of the drive shaft about its central axis, causes rotational motion of the crank pin such that the central axis of the crank pin rotates about the central axis of the drive shaft. Thus, the orbiting scroll orbits within the housing. A rotation prevention means is provided to prevent rotation of the orbiting scroll during orbital motion. A pair of balance weights are attached about the drive shaft, one on either axial end of the crank pin.

In operation, orbital motion of the orbiting scroll causes the fluid pockets to decrease in volume, thus increasing the pressure of the fluid therein. The increasing pressure in the fluid pockets acts equally on both sides of the single plate member, in a direction which is generally parallel to the axis of the crank shaft. Since the pressure on either side of the plate member is generally equal, no net axial force acts on the plate member. Therefore, since no net axial force acts on the plate member, undesirable bending or warping of the plate member is avoided.

However, although the scroll type supercharger as described in the German publication does not suffer from the drawback of bending or warping of the orbiting scroll member, in order to achieve this feature, both the first and second orbiting spiral elements must be formed on opposite sides of a single end plate member. Great difficulty is encountered in manufacturing the orbiting scroll with a sufficient degree of accuracy so as to achieve the necessary relative location of the first spiral element with respect to the second spiral element such that the first and second spiral elements simultaneously interfit with the third and fourth fixed spiral elements, respectively, for efficient operation of the supercharger. Accordingly, due to the difficulty of machining the orbiting scroll, low productivity is obtained with a corresponding high costs of manufacturing in the above type supercharger.

SUMMARY OF THE INVENTION

It is the primary object of this invention to provide a scroll type supercharger including an orbiting scroll having first and second orbiting spiral elements, which may be inexpensively manufactured with a high degree of precision.

It is also an object of the present invention to provide a scroll type supercharger having an orbiting scroll which is resistant to bending or warping due to the increased pressure on the end plates of the scroll.

A scroll type supercharger according to the present invention includes a front and rear casing from which first and second fixed spiral elements extend. The casings are fixed together in an opposing relationship, and enclose an operating chamber therebetween. An orbiting scroll is disposed within the operating chamber, and includes first and second orbiting end plates having first and second orbiting spiral elements extending therefrom. The orbiting end plates are fixed together to form the orbiting scroll such that the first and second spiral elements extend from opposite sides. The first and second spiral elements of the orbiting scroll interfit with the first and second fixed spiral elements such that an angular and radial offset is formed between the fixed and orbiting spiral elements to form at least one pair of fluid pockets therebetween, for each set of fixed and orbiting spiral elements.

The first and second orbiting end plates are fixed together to form a hollow portion therebetween. A drive mechanism includes a drive shaft having a drive pin element fixed to and disposed thereabout, such that the longitudinal axis of the pin element is offset from that of the drive shaft. The first and second orbiting end plates are supported about the pin element by bearings.

Thus, rotational motion of the drive shaft causes the longitudinal axis of the pin to rotate about the longitudinal axis of the drive shaft, and rotation of the drive pin element causes orbital motion of the orbiting scroll. A rotation preventing device prevents rotational motion of the orbiting scroll during orbital motion thereof. A central fluid pocket is formed at a central location at each interfitting pair of scrolls. The central fluid pocket is linked to the hollow portion such that the pressure on either side of each of the first and second end plates of the orbiting scroll may be equalized during operation to prevent bending or warping of the end plate elements of the orbiting scroll. A balance weight is disposed for on one side of the pin element, and rotates about the axis of the drive shaft within the hollow portion formed between the two orbiting end plates. Since two orbiting end plates are utilized, each having an orbiting spiral element extending therefrom, instead of the single orbiting end plate of the prior art, the degree of difficulty in manufacturing an orbiting scroll with sufficient accuracy is greatly reduced as is the manufacturing cost.

DETAILED DESCRIPTION OF THE PREFERRED EMBODIMENT

In the following, the left side of FIG. 1 will be referenced as the forward or front end, while the right side will be referenced as the rearward end. The designations right, left, front or rear are used merely for the sake of convenience of description, and the invention is not limited in this manner.

Figure 1:
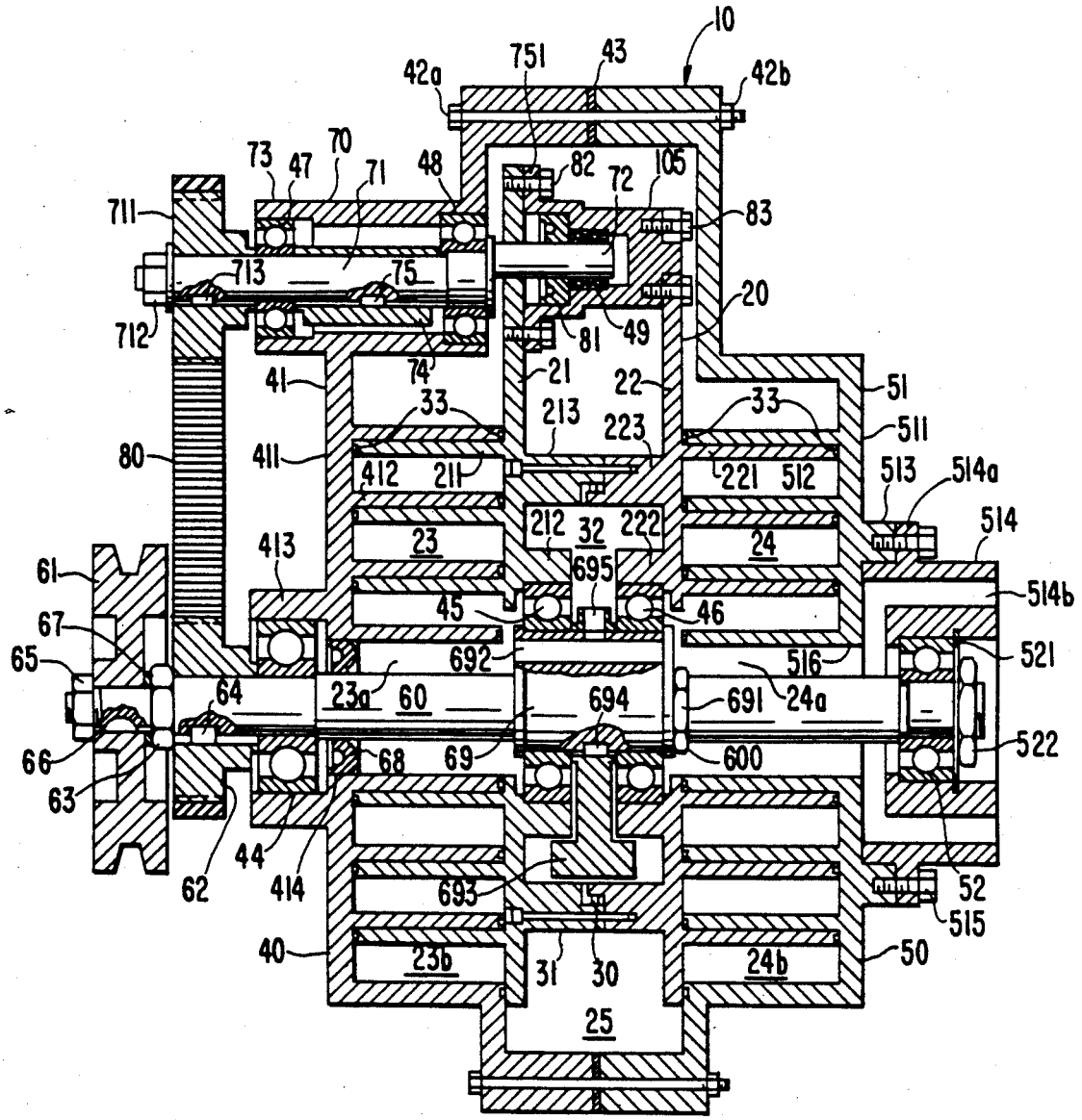
FIG. 1 shows a vertical longitudinal section view of the scroll type supercharger in accordance with the present invention.

With reference to FIG. 1, scroll type supercharger 10 in accordance with the present invention is shown. Supercharger 10 includes front casing 40 (to the left of FIG. 1), including first fixed scroll 41 further including first fixed end plate 411 from which first fixed spiral element 412 extends. Rear casing 50 (to the right of FIG. 1), includes second fixed scroll 51 further including second end plate 511 from which second fixed spiral element 512 extends. Front casing 40 and rear casing 50 are firmly joined together by a plurality of bolts **42*a* and 42*b* to define operational chamber 25 therebetween. Gasket 43** is disposed between the opposing surfaces of the front and rear casings.

Orbiting scroll 20 is disposed within operating chamber 25 and includes first and second orbiting end plate members 21 and 22 from which first and second orbiting spiral elements or wraps 211 and 221 extend, respectively. First and second spiral elements 211 and 221 extend from opposite directions from orbiting scroll 20. First and second bosses 212 and 222 are formed on the axial end surface of each of first and second orbiting end plate members 21 and 22, such that the first and second bosses are on opposite sides of the end plate members from first and second orbiting spiral elements 211 and 221. The orbiting end plates are disposed such that bosses 212 and 222 are opposite each other. Additionally, first and second annular projections 213 and 223 are formed on the axial end surface of first and second orbiting end plate members 21 and 22 respectively, at a location which is radially outward from the location of the bosses. Annular projections 213 and 223 are longer than bosses 212 and 222 and projections 213 and 223 are in contact around the bosses to define hollow portion 32 between first and second orbiting end plate members 21 and 22.

The axial tip surface of first annular projection 213 includes a further projection disposed generally on an exterior side with respect to hollow portion 32. A similar further projection is formed on second annular projection 223, and has a smaller cross-section and is disposed generally inwardly with respect to hollow portion 32. First and second annular projections 213 and 223 contact each other such that an empty space is formed between the further projections. O-ring 30 is disposed within the empty space to seal the mating axial ends of first and second projections 213 and 223. A plurality of bolts 31 are disposed through first and second projections 213 and 223 from the end surface side of first orbiting end plate member 21 to firmly secure first end plate member 21 to second end plate member 22 with hollow portion 32 therebetween.

First orbiting end plate member 21 of orbiting scroll 20 and first fixed scroll 41 are disposed at an angular and radial offset with respect to each other, such that first fixed spiral element 412 and first orbiting spiral element 211 interfit to form at least one pair of fluid pockets 23. Third boss 413 is centrally formed on an exterior surface of first fixed end plate 411, that is, on the surface opposite fixed spiral element 412. Second orbiting end plate member 22 of orbiting scroll 20 and second fixed scroll 51 are disposed at an angular and radial offset with respect to each other such that second fixed spiral element 512 and second orbiting spiral element 221 interfit to form at least one pair of fluid pockets 24 therebetween. Fourth boss 513 is centrally formed on an exterior surface of second fixed end plate 511, that is, on the side opposite from second fixed spiral element 512. Each of the spiral elements 211, 221, 412 and 512 includes seal element 33 disposed on its axial end surface, in contact with the corresponding opposite end plate.

Adapter 514 includes angular flange portion **514*a* extending outwardly from the outer peripheral surface thereof. Adapter 514 also includes a plurality of outlet ports 514*b* formed therethrough. Adapter 514 is disposed within the inner peripheral wall of fourth boss 513 such that flange portion 514*a* is in contact with fourth boss 513. A plurality of bolts 515 are screwed into flange portion 514*a* and fourth boss 513 to firmly secure adapter 514 to rear casing 50**.

Drive mechanism 600 includes drive shaft 60. Central openings 414 and 516 are formed through first and second fixed end plates 411 and 511 respectively such that drive shaft 60 is disposed therethrough. Bearings 44 and 52 are forcibly disposed within the inner peripheral walls of third boss 413 and adapter 514 respectively. Drive shaft 60 is rotatably supported within third boss 413 and adapter 514 via bearings 44 and 52 respectively. Adapter 514 includes a central opening formed therethrough, and having a projecting portion extending into the central opening near one axial end surface thereof. Bearing 52 is secured against the projecting portion, within adapter 514 by snap ring 521 and nut 522.

Toothed wheel 62 is disposed about and near the forward end of drive shaft 60 (to the left of FIG. 1), at a location exterior to the axial end surface of third boss 413, and securely holds bearing 44 within boss 413.

Toothed wheel 62 is firmly secured on drive shaft 60 by nut 63 and key mechanism 64. Pulley 61 is mounted on the forward end of drive shaft 60, at a position forward of toothed wheel 62. Pulley 61 is firmly secured on drive shaft 60 by nut 65 and key mechanism 66. Spacer 67 is disposed between nut 63 and pulley 61. Shaft seal mechanism 68 is disposed within central opening 414 of first fixed end plate 411, at a location to the rear of bearing 44, and surrounds drive shaft 60. Rotation of pulley 61 causes corresponding rotation of drive shaft 60, which further results in corresponding rotation of toothed wheel 62.

Figure 3:
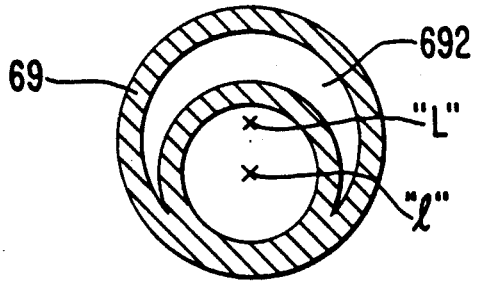
FIG. 3 is a cross-sectional view of the crank pin of the present invention.

With reference to FIGS. 1 and 3, crank pin 69 is disposed about and firmly secured to a central portion of drive shaft 60 by nut 691. The longitudinal axis "L" of crank pin 69 is radially offset from the longitudinal axis "l" of drive shaft 60 by a predetermined distance. Cavity 692 is longitudinally disposed through crank pin 69, at a location exterior of drive shaft 60. Fluid pockets 23 and 24 include central fluid pockets **23*a* and 24*a* disposed on either side of the end plates of the orbiting scroll 20 and surrounding drive shaft 60. Cavity 692 links central fluid pockets 23*a* and 24*a*. Bearings 45 and 46 are forcibly disposed on the inner peripheral walls of bosses 212 and 222 respectively. Orbiting scroll 20 is supported on crank pin 69 at bosses 212 and 222 by bearings 45 and 46. Rotation of drive shaft 60 causes simultaneous rotation of crank pin 69 such that the longitudinal axis of crank pin 69 rotates about the longitudinal axis of drive shaft 60. Since crank pin 69 is non-symmetrically disposed on drive shaft 60, rotation of the drive shaft and crank pin cause first and second orbiting end plate members 21 and 22 of orbiting scroll 20** to synchronously and simultaneously undergo orbital motion.

Balance weight 693 is fixedly disposed on crank pin 69 by key mechanism 694. Balance weight 693 is disposed on crank pin 69 on the opposite side of the longitudinal axis of drive shaft 60 from the longitudinal axis of crank pin 69. Rotation of drive shaft 60 causes balance weight 693 to undergo rotational motion with respect to the longitudinal axis of drive shaft 60, and balance weight 693 moves within hollow portion 32 formed between the orbiting end plates. Port 695 is radially formed through crank pin 69 at a central location, linking cavity 692 with hollow portion 32.

Rotation preventing mechanism 70 includes crank shaft 71 having pin member 72 extending from a rear end thereof. The longitudinal axis of pin member 72 is radially offset from the longitudinal axis of crank shaft 71 by a predetermined distance which is the same as the predetermined distance between the longitudinal axis of crank pin 69 and the longitudinal axis of drive shaft 60. Cylindrical extending portion 73 is formed at the peripheral front surface of casing 40 and crank shaft 71 extends therethrough, essentially in parallel with drive shaft 60. A pair of bearings 47 and 48 are disposed in opposite ends of cylindrical portion 73, on inner peripheral surfaces thereof to rotatably support crank shaft 71 therein. Balance weight 74 is disposed about crank shaft 71 on an opposite side of the longitudinal axis of crank shaft 71 from the longitudinal axis of pin member 72. Balance weight 74 is fixedly secured to crank shaft 71 by key mechanism 75. Toothed wheel 711 is mounted onto the front end of crank shaft 71 which extends beyond cylindrical portion 73, and toothed wheel 711 is firmly secured to crank shaft 71 by nut 712 and key mechanism 713. Toothed wheel 711 is generally similar to toothed wheel 62 such that each of the toothed wheels has the same diameter and the same number of teeth. Timing belt 80 extends around both toothed wheel 711 and 62 such that rotation of toothed wheel 62 by pulley 61 causes synchronous and simultaneous rotation of toothed wheel 711 through timing belt 80.

Open end cup-shaped casing 105 includes bearing 49 disposed on an inner peripheral portion thereof, and shaft seal 81 also disposed an inner peripheral surface thereof, at a position which is closer to the opened end than bearing 49. Casing 105 is disposed between peripheral surfaces of first and second orbiting end plate members 21 and 22. The open end of casing 105 includes angular flanges 751 extending radially therefrom and in contact with the rearward surface of end plate member 21. Flange 751 is fixed to end plate member 21 by a plurality of bolts 82, while the rear end of casing 75 is firmly fixedly secured to second end plate member 22 by a plurality of bolts 83. Pin member 72 extends through an opening in first end plate member 21, into the interior of casing 105. Pin member 72 is rotatably supported within casing 105 by bearing 49. Shaft seal 81 is mounted onto pin member 72, forward of the location of bearing 49. Since pin member 72 undergoes an identical rotational motion with respect to the axis of shaft 71 as the axis of crank pin 69 does with respect to the axis of drive shaft 60, and since pin member 72 extends into orbiting scroll 20 and is in substantial contact therewith, when first and second end plate members 21 and 22 undergo orbital motion, rotation of the end plate members is prevented by the synchronous motion of pin member 72. That is, the contact between orbiting scroll 20 and pin member 72 allows orbiting motion but prevents rotational motion of orbiting scroll 20.

Figure 2:
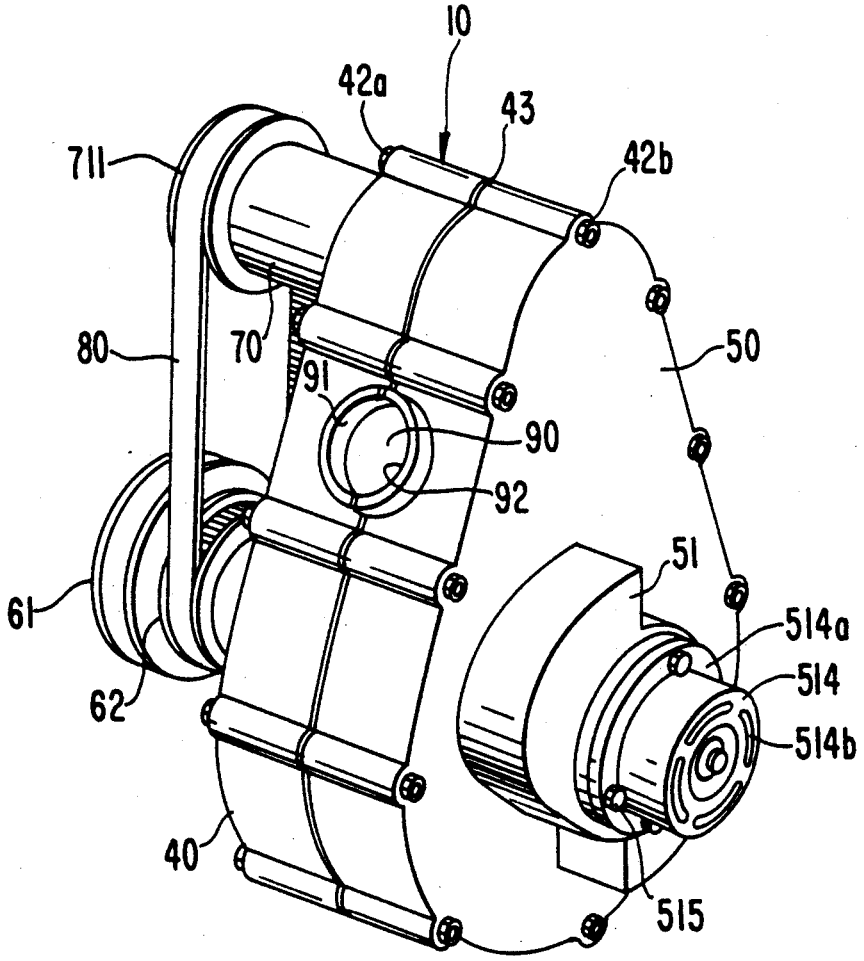
FIG. 2 is a perspective exterior view of the scroll type supercharger shown in FIG. 1.

With respect to FIG. 2, semi-circular cut-outs 91 and 92 are formed respectively in front and rear casings 40 and 50, and oppose each other when casings 40 and 50 are fixedly attached. Thus, holes 91 and 92 form circular port 90 through which air may be introduced into operational chamber 25.

In operation, a driving force is transferred to pulley 61 from an exterior power source, such as, the engine of the vehicle (not shown) through a belt (not shown), to cause drive shaft 60 to rotate. Rotation of drive shaft 60 is converted into orbital motion of orbiting scroll 20 through rotational motion of the longitudinal axis of crank pin 69 with respect to the longitudinal axis of drive shaft 60. Rotational motion is prevented by rotation preventing mechanism 70. Fluid, for example air, is introduced into operational chamber 25 through port 90 and is taken into the outer fluid pockets **23*b* and 24*b* on either side of orbiting scroll 20, between first orbiting end plate member 21 of orbiting scroll 20 and first fixed end plate 411 of first fixed scroll 41, and between second orbiting end plate member 22 of orbiting scroll 20 and second fixed end plate member 511 of fixed scroll 51, respectively. As orbiting scroll 20 undergoes orbital motion, the air moves inwardly towards the center of spiral elements 211 and 412, and 221 and 521 respectively, towards central fluid pockets 23*a* and 24*a*, respectively. The air undergoes a resultant volume reduction and compression as it moves toward the central pocket, for example, 0.1–0.8 $kg/cm^2$ G. The compressed air is discharged to an outlet pipe (not shown) through outlet ports 514*b* at a high discharge rate, linking supercharger 10** to the engine of the vehicle.

Additionally, compressed air in central fluid pocket **23*a* flows through cavity 692 and is mixed with air in central fluid pocket 24a before being discharged to the outlet pipe. Part of the compressed air flows into hollow portion 32 through cavity 692 and port 695 such that hollow portion 32 is filled with compressed air. As a result, the axial pressure exerted by the compressed air in hollow portion 32 on one side of the orbiting end plates is opposite in direction to the pressure exerted on the opposite sides of first and second orbital end plate members 21 and 22 by compressed air in the fluid pockets. Therefore, since the axial forces are generally equal and opposite, the net axial force is minimal, and bending and warping of first and second orbiting end plate members 21 and 22 is prevented. Furthermore, due to the disposition of balance weight 693 within hollow portion 32**, the dimensions of the casings of the supercharger are reduced.

This invention has been described in detail in connection with the preferred embodiment. This embodiment, however, is merely for example only and the invention is not restricted thereto. It will be understood by those skilled in the art that other variations and modifications can easily be made within the scope of this invention as defined by the appended claims.

I claim:

1. In a scroll type fluid apparatus including first and second casings disposed adjacent to each other to form an operating chamber therebetween, said first casing including a first fixed scroll having a first fixed end plate from which a first fixed spiral element extends within said operating chamber, said second casing including a second fixed scroll having a second fixed end plate from which a second fixed spiral element extends within said operating chamber, an orbiting scroll disposed within said operating chamber and having first and second orbiting spiral elements extending from opposite surfaces thereof, said orbiting scroll disposed within said chamber at an angular and radial offset with respect to said first fixed scroll and at an angular and radial offset with respect to said second fixed scroll such that said first fixed spiral element and said first orbiting spiral element interfit to form at least one pair of fluid pockets therebetween, and said second fixed spiral element and said second orbital spiral element interfit to form at least one pair of fluid pockets therebetween, respectively, a drive mechanism including a drive shaft operatively connected to said orbiting scroll to effect orbital motion of said orbiting scroll within said operating chamber, said drive shaft having a balance weight fixedly disposed thereon, and rotation preventing means for preventing rotational motion of said orbiting scroll during orbital motion of said orbiting scroll, the improvement comprising:

said orbiting scroll including first and second orbiting end plate members linked together to enclose a hollow portion therebetween, said first and said second orbiting spiral elements extending from said first and second orbiting end plate members, said balance weight disposed in said hollow portion, said balance weight rotating about the longitudinal axis of said drive shaft and within said hollow portion.

2. The scroll type fluid apparatus of claim 1, said hollow portion linked to said fluid pockets.

3. The scroll type fluid apparatus of claim 1, said first and second orbiting end plate members comprising first and second axial annular projections respectively, said first and second axial annular projections extending from the opposite surfaces of said first and second end plate members from the surfaces from which said first and second orbiting spiral elements extend, the axial end surfaces of said first and second axial annular projections contacting each other to define said hollow portion therebetween.

4. The scroll type fluid apparatus of claim 1, said drive mechanism further comprising a crank pin disposed about and fixed to said drive shaft, said crank pin having a longitudinal axis offset from the longitudinal axis of said drive shaft such that said longitudinal axis of said crank pin rotates about said longitudinal axis of said drive shaft.

5. The scroll type fluid apparatus of claim 4, said first and second orbiting end plate members of said orbiting scroll comprising inwardly projecting bosses on the surfaces opposite of said orbiting spiral elements, said orbiting scroll supported on said crank pin at said bosses such that the rotational motion of said crank pin causes orbiting motion of said orbital scroll.

6. The scroll type fluid apparatus recited in claim 4, said crank pin disposed within said hollow portion.

7. The scroll type fluid apparatus recited in claim 4, both of said at least one pair of fluid pockets including a central fluid pocket disposed about said drive shaft on opposite sides of said orbiting scroll, said crank pin including a longitudinal conduit extending therethrough linking said central fluid pockets.

8. The scroll type fluid apparatus of claim 7, said crank pin including a radial bore extending therethrough at a central location, said radial bore linking said longitudinal conduit to said hollow portion such that compressed fluid from at least one said central fluid pocket flows into said hollow portion.

9. The scroll type fluid apparatus of claim 4, said balance weight fixedly secured to said crank pin at a side opposite of said longitudinal axis of said crank pin with respect to the longitudinal axis of said drive shaft.

10. In a scroll type fluid apparatus including first and second casings disposed adjacent to each other to form an operating chamber therebetween, said first casing including a first fixed scroll having a first fixed end plate from which a first fixed spiral element extends within said operating chamber, said second casing including a second fixed scroll having a second fixed end plate from which a second fixed spiral element extends within said operating chamber, an orbiting scroll disposed within said operating chamber and having first and second orbiting spiral elements extending from opposite surfaces thereof, said orbiting scroll disposed within said chamber at an angular and radial offset with respect to said first fixed scroll and at an angular and radial offset with respect to said second fixed scroll such that said first fixed spiral element and said first orbiting spiral element interfit to form at least one pair of fluid pockets therebetween, and said second fixed spiral element and said second orbital spiral element interfit to form at least one pair of fluid pockets therebetween, respectively, a drive mechanism including a drive shaft operatively connected to said orbiting scroll to effect orbital motion of said orbiting scroll within said operating chamber, said drive shaft having a crank pin disposed about and fixed thereto, and rotation preventing means for preventing rotational motion of said orbiting scroll during orbital motion of said orbiting scroll, the improvement comprising:

said orbiting scroll including first and second orbiting end plate members linked together to enclose a hollow portion therebetween, said first and said second orbiting spiral elements extending from said first and second orbiting end plate members, both of said at least one pair of fluid pockets including a central fluid pocket disposed about said drive shaft on opposite sides of said orbiting scroll, said crank pin including a longitudinal conduit extending therethrough and linking said central fluid pockets.

11. A scroll type fluid apparatus comprising:

first and second casings disposed adjacent to each other to form an operating chamber therebetween, said first casing including a first fixed scroll having a first fixed end plate from which a first fixed spiral element extends within said operating chamber, said second casing including a second fixed scroll having a second fixed end plate from which a second fixed spiral element extends with said operating chamber, an orbiting scroll having first and second orbiting spiral elements extending from first and second orbiting end plate members, respectively, said first and second orbiting end plate members fixed together to form a hollow portion therebetween, a drive shaft for driving said orbiting scroll, rotation preventing means for preventing rotational motion of said orbiting scroll during orbital motion of said orbiting scroll, said rotation preventing means comprising a crank shaft drivingly connected with said drive shaft, said crank shaft engaging said first and second orbiting end plate members.

12. The scroll type fluid apparatus according to claim 11, said crank shaft including a balance weight disposed thereabout.

13. The scroll type fluid apparatus according to claim 11, said crank shaft drivingly connected to a pin member, the longitudinal axis of said pin member radially offset from the longitudinal axis of said crank shaft.

14. The scroll type fluid apparatus according to claim 13 comprising an open end cup-shaped casing linking peripheral surfaces of said first and second orbiting end plate members.

15. The scroll type fluid apparatus according to claim 14, said pin member disposed in said open end cup-shaped casing.

* * * * *